US006277220B1

(12) United States Patent
Hamada et al.

(10) Patent No.: US 6,277,220 B1
(45) Date of Patent: Aug. 21, 2001

(54) STEEL WIRE ROD AND PROCESS FOR PRODUCING STEEL FOR STEEL WIRE ROD

(76) Inventors: Takanari Hamada, 13-20-211, Kamitomino 2-chome; Yusuke Nakano, 12-7-303, Kamitomino 2-chome, both of Kokurakita-ku, Kitakyushu-shi, Fukuoka 802-0022; Yukio Ishizaka, 10-3, Kyomachi 1-chome, Kanda-machi, Miyako-gun, Fukuoka 800-0351, all of (JP)

( * ) Notice: Subject to any disclaimer, the term of this patent is extended or adjusted under 35 U.S.C. 154(b) by 0 days.

(21) Appl. No.: 09/503,713

(22) Filed: Feb. 14, 2000

Related U.S. Application Data

(63) Continuation of application No. PCT/JP99/03307, filed on Jun. 21, 1999.

(30) Foreign Application Priority Data

| | | |
|---|---|---|
| Jun. 23, 1998 | (JP) | 10-176273 |
| Dec. 10, 1998 | (JP) | 10-350824 |
| Feb. 25, 1999 | (JP) | 11-048289 |
| Apr. 13, 1999 | (JP) | 11-105749 |

(51) Int. Cl.[7] ..... C21D 9/52
(52) U.S. Cl. ..... 148/595; 148/320
(58) Field of Search ..... 148/595, 598, 148/599

(56) References Cited

U.S. PATENT DOCUMENTS 5,534,084 * 7/1996 Wakoh et al. ..... 148/328

FOREIGN PATENT DOCUMENTS

| | | |
|---|---|---|
| 61-136612 | 6/1986 | (JP) . |
| 62-099436 | 5/1987 | (JP) . |
| 62-099437 | 5/1987 | (JP) . |
| 02-285029 | 11/1990 | (JP) . |
| 06-212238 | 8/1994 | (JP) . |
| 08-143940 | 6/1996 | (JP) . |
| 08-225820 | 9/1996 | (JP) . |
| 09-125199 | 5/1997 | (JP) . |
| 09-125200 | 5/1997 | (JP) . |
| 09-209075 | 8/1997 | (JP) . |
| 11-131191 | 5/1999 | (JP) . |

OTHER PUBLICATIONS

Metals Handbook: vol. 1 Properties and Selection: Irons, Steels, and High–Performance Alloys, 10th ed. , (1990) p 272.*

"Behavior of Calcium Aluminates During Hot Rolling of Continuous Casting Steels", Gonzales, Metallurgical Science and Technology, vol. 11, No. 3, pp. 105–109 (1993).

Recent Development of Production Technology For Super–Clean Wire Rod, 126th and 127th Nishiyama Memorial Technical Course, pp. 147–165, 1988.

* cited by examiner

*Primary Examiner*—George Wyszomierski
*Assistant Examiner*—Janelle Combs-Morillo

(57) ABSTRACT

The steel wire rod contains oxides which comprises, on the weight % basis, $SiO_2$, 70% or more; $CaO+Al_2O_3$, less than 20%; and $ZrO_2$, 0.1 to 10% in the average composition of oxides of 2 $\mu$m or more in width on a longitudinal section thereof. This wire rod is excellent in cold workability such as drawability, and steel wires which have high fatigue strength can be produced from this wire rod as stock steel.

10 Claims, 1 Drawing Sheet

STEEL WIRE ROD AND PROCESS FOR PRODUCING STEEL FOR STEEL WIRE ROD

This application is a continuation of international application PCT/JP99/03307 filed on Jun. 21, 1999.

FIELD OF THE INVENTION

The present invention relates to steel wire rods, a process for producing steel for steel wire rods, and a process for producing fine steel wires. The present invention relates in particular to steel wire rods suitable for products requiring excellent fatigue resistance and cold workability, for example, workability in drawing, in rolling and in stranding, such as wire rope, valve springs, suspension springs, PC wires and steel cord, and a process for producing steel having high cleanliness serving as a stock for the steel wire rods, and a process for producing fine steel wires made of the steel wire rods as a stock.

BACKGROUND OF THE INVENTION

Wire ropes, valve springs, suspension springs and PC wires are produced generally by subjecting steel wire rods obtained by hot rolling (hereinafter referred to simply as "wire rods") to cold working such as drawing or cold rolling and further to the thermal refining treatment of quenching and tempering or to bluing treatment. In addition, fine steel wires for steel cords used as reinforcing materials in radial tires for automobiles are produced by subjecting wire rods of about 5.5 mm in diameter after hot rolling and controlled cooling to primary drawing, patenting treatment, secondary drawing and final patenting treatment and then to brass plating and final wet drawing. A plurality of fine steel wires obtained in this manner are further twisted into a twisted steel wire to produce a steel cord.

Generally, productivity and yield are greatly decreased if breakage occurs upon formation of wire rods into steel wires. Accordingly, it is strongly desired that wire rods in the technical fields described above are not liable to breakage during drawing or cold rolling, particularly during wet drawing where severe cold working is conducted for production of steel cords. Similarly, it is required that breakage does not occur during stranding for twisting a plurality of fine steel wires.

In recent years, there is increasing demand for light-weighing of various products such as wire ropes, valve springs, suspension springs, PC wires and steel cords in the background of cost reduction and global environmental problem. Accordingly, steel products for high strength in these uses are actively researched. However, as the strength of steel products is raised, their ductility and toughness are generally lowered thus deteriorating drawing workability, cold workability in rolling and workability in stranding, and they are also rendered liable to fatigue breakage. Accordingly, wire rods serving as stock for the various products described above are required to be excellent particularly in the internal states thereof.

Accordingly, for the purpose of improving drawing and cold workability for wire rods, simultaneously improving workability in stranding of steel wires and further improving fatigue resistance for the products, techniques directed to cleanliness of steel have been developed. For simplicity in the following description, the drawing workability and cold workability in rolling of wire rods and the workability in stranding of steel wires may also be referred to collectively as "cold workability".

For example, the 126th and 127th Nishiyama Memorial Technical Course, pp. 148 to 150 shows the technique of controlling non-metallic inclusions (hereinafter referred to simply as inclusions) to the region of a ternary low-melting composition which readily undergoes plastic deformation during hot rolling, to make them harmless as deformable inclusions.

JP-A 62-99436 discloses steel wherein an inclusion is limited to a less deformable one with a ratio of length (L)/width (d)≦5, and the average composition of the inclusion comprises $SiO_2$, 20 to 60%; MnO, 10 to 80%; and either one or both of CaO, 50% or less and MgO, 15% or less.

JP-A 62-99437 discloses steel wherein an inclusion is limited to a less deformable one with a ratio of length (L)/width (d)≦5, and the average composition of the inclusion comprises $SiO_2$, 35 to 75%; $Al_2O_3$, 30% or less; CaO, 50% or less; and MgO, 25% or less.

The techniques disclosed in JP-A 62-99436 and JP-A 62-99437 are substantially identical to the technical content reported in the above-described Nishiyama Memorial Technical Course in respect of the technical idea of lowering the melting point of inclusions. The techniques proposed in these 2 publications are those wherein the composition of multicomponent inclusions including MnO and MgO is controlled to lower the melting point, and the inclusions are sufficiently drawn during hot rolling and then the inclusions are disrupted and finely dispersed by cooling rolling or drawing whereby cold workability and fatigue resistance are improved.

However, the interfacial energy of inclusions is very small. Accordingly, the inclusions are readily aggregated and agglomerated in the process of from secondary refining such as ladle refining having a gas bubbling or arc reheating process to casting, so they tend to remain as giant inclusions at the stage of continuously casted slabs. Once the giant inclusions are generated, there is the possibility that even if the average composition of inclusions is the same, crystallization of a heterogeneous phase occurs more frequently in the process of solidification in identical inclusions, as shown in FIG. 1. In FIG. 1, the shaded portion is a heterogeneous phase. Accordingly, even in the case of the composition of inclusions proposed in the respective publications described above, that is, in the case where the average composition of inclusions is regulated, if giant inclusions with a heterogeneous composition are crystallized, the regions of giant inclusions with the composition proposed in the publications are soft and thus made small by hot rolling and cold rolling or drawing, but the portions of giant inclusions not having the composition proposed in the publications can remain large, so there is a limit to the improvement of cold workability and fatigue resistance.

On the other hand, the techniques wherein the size and number of rigid inclusions adversely affecting cold workability and further fatigue resistance are specified are disclosed in JP-A 9-125199, JP-A 9-125200, and JP-A 9-209075. However, the techniques proposed in these publications are those wherein, for example, a test specimen taken from a wire rod of 5.5 mm in diameter obtained by hot rolling is dissolved in a specified solution, and its residues i.e. rigid oxide inclusions (hereinafter referred to simply as oxides) are measured for their size and number, whereby the cleanliness of the steel and steel products can be specified for the first time. Accordingly, if facilities for melting steel are different or if the chemical composition of steel is different, steel and steel products having desired high cleanliness cannot necessarily be obtained stably according to the techniques disclosed in the publications described above.

SUMMARY OF THE INVENTION

The object of the present invention is to provide wire rods suitable for use in requiring excellent fatigue resistance and excellent cold workability, such as wire ropes, valve springs, suspension springs, PC wires and steel cords, and a process for producing steel having high cleanliness serving as a stock for the wire rods, and a process for producing fine steel wires made of the wire rods as the stock.

The gist of the present invention is as follows:

(1) A steel wire rod containing oxides, wherein the average composition of oxides of 2 μm or more in width on a longitudinal section thereof comprises, on the weight % basis, $SiO_2$, 70% or more; $CaO+Al_2O_3$, less than 20%; and $ZrO_2$, 0.1 to 10%.

(2) A process for producing a steel for use in the wire rod described in item (1) above, which comprises primary refining in a converter, and secondary refining outside the converter, followed by continuous casting.

(3) A process for producing fine steel wires, wherein the wire rod described in item (1) above is subjected to cold working and then subjected to final heat-treatment, plating and wet drawing in this order.

The "longitudinal section" (referred to hereinafter as "L section") of the wire rod referred to in the present invention refers to a face which is parallel to the direction of rolling of the wire rod, and is cut through a central line thereof. The "width" of oxides refers to the maximum length of individual oxides on the L section in the crosswise direction. The same definition applies where the form of oxides is a granular form.

"$CaO+Al_2O_3$" refers to the total amount of CaO and $Al_2O_3$.

The term "wire rod" refers to steel products comprising a hot-rolled steel bar wound in the form of a coil, and includes the so-called "bar in coil".

The term "secondary refining" refers to what is usually called "refining outside a converter", which is "refining outside a converter for cleaning a steel" such as ladle refining having a gas bubbling or arc reheating process and refining using a vacuum treatment apparatus.

The term "steel wire" refers to a product produced by winding a wire rod into a coil after cold working. Cold working of the wire rod into a steel wire includes not only drawing using a conventional wire drawing die but also drawing using a roller die and cold rolling using the so-called "2-roll rolling mill", "3-roll rolling mill" or "4-roll rolling mill".

The term "final heat-treatment" refers to final patenting treatment. The term "plating" refers to plating such as brass plating, Cu plating and Ni plating conducted to reduce drawing resistance in the subsequent process of wet drawing or to improve adhesion to rubber for use in steel cords.

DETAILED DESCRIPTION OF THE INVENTION

Figure 1:
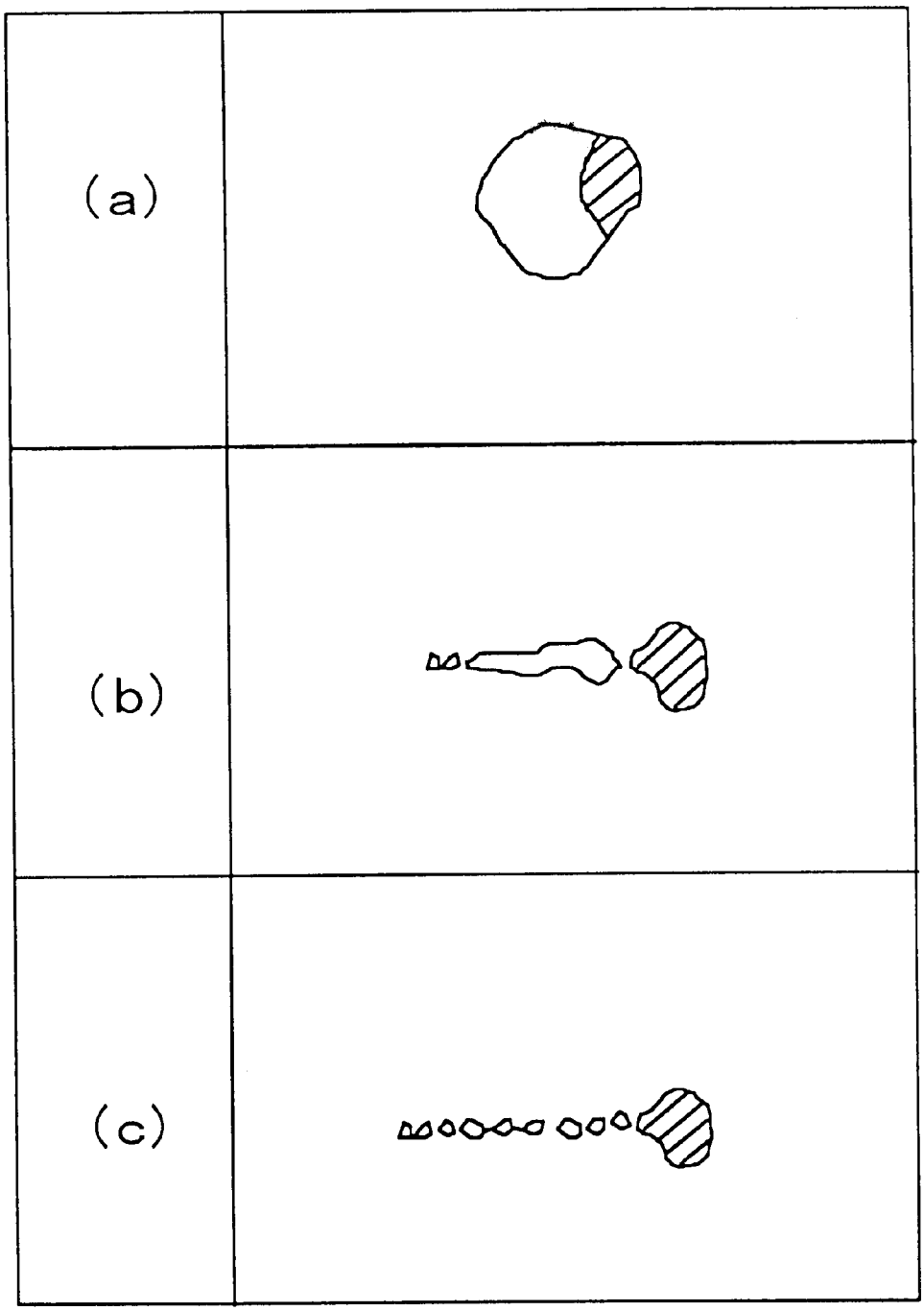
FIG. 1 is a conceptual drawing showing that when a giant inclusion with a heterogeneous composition is crystallized, a soft portion in the giant inclusion is made small by hot rolling and cold rolling or drawing, while a rigid portion in the inclusion remains large. The shaded portion shows a heterogeneous phase. In the drawing, (a), (b) and (c) indicate the inclusion in slab, wire rod and steel wire, respectively.

The inventors conducted extensive investigation and study to obtain wire rods suitable for use in wire ropes, valve springs, suspension springs, PC wires, and steel cords requiring excellent fatigue resistance and excellent cold workability. That is, the inventors extensively investigated and studied the relationship between oxides in wire rods and fatigue resistance or cold workability (drawability and workability in stranding). As a result, they obtained the findings (a) and (b) described below:

(a) Conventionally, silicate inclusions with high-melting point have been avoided as "rigid inclusions" which adversely affect cold workability and fatigue resistance. However, if a suitable amount of $ZrO_2$ is compounded with the silicate inclusions, the surface tension of the silicate inclusions in molten steel is increased and the inclusions become finely dispersed and do not affect cold workability and fatigue resistance. The "silicate inclusions" described above refer not only to $SiO_2$ but also to complex oxide inclusions containing $SiO_2$.

(b) To improve fatigue resistance and cold workability, the average composition of oxides of 2 μm or more in width on the L section of the wire rod may comprise, on the weight % basis, $SiO_2$, 70% or more; $CaO+Al_2O_3$, less than 20%; and $ZrO_2$, 0.1 to 10%.

Accordingly, the inventors then made further extensive investigation and study on a process for producing a steel such that the type and composition of oxides are shown in the item (b) above, and arrived at the following findings:

(c) The process of primary refining in a converter and secondary refining outside the converter is very effective for reduction of impurity elements in steel, and furthermore, the steel is thereafter casted continuously into steel ingots, thus making the production cost relatively low.

(d) In the production of steel in the process of primary refining in a converter, secondary refining outside the converter and continuous casting, the oxides in item (b) above (that is, those comprising, on the weight % basis, $SiO_2$, 70% or more; $CaO+Al_2O_3$, less than 20%; and $ZrO_2$, 0.1 to 10% in the average composition of oxides of 2 μm or more in width on the L section of the wire rod) can be realized by suitably controlling the amount of metal Al introduced into molten steel or the amount of metal Al mixed as an incidental impurity (hereinafter referred to simply as the "amount of mixed Al") in the process of from primary refining in a converter to continuous casting, the amount of $Al_2O_3$ in flux and refractories in contact with molten steel (hereinafter referred to simply as the "amount of $Al_2O_3$ such as in flux"), the amount of $ZrO_2$ contained in at least one of said refractories and flux (hereinafter referred to simply as the "amount of $ZrO_2$ such as in flux") and the final $CaO/SiO_2$ ratio in slag in a ladle in contact with molten steel in the process of secondary refining and subsequent steps (hereinafter referred to simply as the "final $CaO/SiO_2$ ratio").

The present invention was completed on the basis of the findings described above.

Hereinafter, the respective requirements of the present invention are described in detail. The term "%" indicating the content of each element and oxide means "% by weight".

(A) Width of Oxides

Oxides of less than 2 μm in width on the L section of the wire rod exert little influence on fatigue resistance and cold workability. Further, because the oxides of less than 2 μm in width are fine, the matrix may be contained therein when their composition is analyzed by physical analytical techniques such as EPMA, so the accurate measurement of their composition is difficult. Accordingly, the width of oxides on the L section of the wire rod was defined as 2 μm or more.

(B) Average Composition of Oxides of 2 μm or More in Width on the L Section of the Wire Rod In the present invention, it is essential that the average composition of oxides of 2 μm or more in width on the L section of the wire rod (hereinafter referred to merely as "average composition") comprises: $SiO_2$, 70% or more; $CaO+Al_2O_3$, less than 20%; and $ZrO_2$, 0.1 to 10%. This is because if $SiO_2$, CaO and $Al_2O_3$ are allowed to be present in the "average composition" together with a predetermined amount of $ZrO_2$, oxides are rendered fine while the composition of inclusions (composition of oxides) is rendered uniform, so oxides serving as an origin of breakage during drawing or as an origin of fatigue breakage can be made very small without making a low-melting composition such as in the prior art.

If only $ZrO_2$ exists, $ZrO_2$ serves as an origin of breakage during drawing or as an origin of fatigue breakage as a rigid inclusion. However, if $ZrO_2$ is present in an amount of 0.1 to 10% as a complex with the above-defined amounts of $SiO_2$, CaO, and $Al_2O_3$ in the "average composition", not only rigid $SiO_2$ but also $ZrO_2$ is finely dispersed and thus they do not exert adverse influence on cold workability and fatigue resistance. In other words, if the amount of $ZrO_2$ contained in the "average composition" exceeds 10%, then $ZrO_2$ inclusions (which include not only $ZrO_2$ but also complex oxide inclusions containing $ZrO_2$, as well as "silicate inclusions") form coarse and rigid inclusions and thus serve as an origin of breakage during drawing and as an origin of fatigue breakage. On the other hand, if the amount of $ZrO_2$ contained in the "average composition" is less than 0.1%, the effect of $ZrO_2$ on fine dispersion of silicate inclusions is hardly obtainable, so the silicate inclusions become rigid inclusions as noted previously, to serve as an origin of breakage during drawing and as an origin of fatigue breakage.

Accordingly, $ZrO_2$ contained in the "average composition" was defined as 0.1 to 10%. $ZrO_2$ contained in the "average composition" is preferably 0.5% or more, more preferably 1.0% or more.

If $SiO_2$ contained in the "average composition" is less than 70% and simultaneously $CaO+Al_2O_3$ is 20% or more, crystallization of a heterogeneous phase occurs more frequently in the process of solidification of steel, thus deteriorating cold workability and fatigue resistance. Accordingly, $SiO_2$ contained in the "average composition" was defined as 70% or more, and simultaneously $CaO+Al_2O_3$ was defined as less than 20%.

$SiO_2$ contained in the "average composition" is preferably more than 75% to 95% or less, and $CaO+Al_2O_3$ is preferably 1% or more to less than 15%.

In the present invention, said "average composition" suffices if it comprises $SiO_2$, 70% or more; $CaO+Al_3$, less than 20% and $ZrO_2$, 0.1 to 10%. Accordingly, it is not particularly necessary to specify the proportion of oxides other than $SiO_2$, CaO, $Al_2O_3$ and $ZrO_2$ (for example, . . . , MgO, MnO, $TiO_2$, $Na_2O$, $Cr_2O_3$ etc.) in "the average composition".

However, the oxides of 2 μm or more in width on the L section of the wire rod are defined as $SiO_2$, CaO, $Al_2O_3$, MgO, MnO and $ZrO_2$, and the sum of the "average composition" in said hexamerous oxide system is assumed to be 100%, and in this "average composition", an amount of 0.1 to 10% $ZrO_2$ may be compounded with an amount of 70% or more $SiO_2$ and an amount of less than 20% $CaO+Al_2O_3$, as described in the Examples below.

To determine the composition of oxides accurately and easily in a short time, for example, a test specimen taken from a wire rod is polished, and its polished face is examined by an EPMA apparatus.

For the desired wire rod in the present invention suitable for uses such as wire ropes, valve springs, suspension springs, PC wires and steel cords requiring excellent fatigue resistance and excellent cold workability, it is not particularly necessary to limit the specific chemical components in steel serving as its stock or the process for producing said steel. However, fatigue resistance and cold workability are varied considerably depending on the chemical components in steel as stock of the wire rod. Accordingly, the chemical components in steel as stock of the wire rod may be defined as follows:

(C) Chemical Components in Steel

C: 0.45 to 1.1%

C is an element effective for securing strength. However, if the content is less than 0.45%, it is difficult to confer high strength on final products such as springs and steel cords. On the other hand, if the content exceeds 1.1%, proeutectoid cementite is formed during the cooling step after hot rolling, which significantly deteriorates cold workability. Accordingly, the content of C is preferably 0.45 to 1.1%.

Si: 0.1 to 2.5%

Si is an element effective for deoxidization, and if the content is less than 0.1%, its effect cannot be demonstrated. On the other hand, if Si is contained excessively in an amount of more than 2.5%, the ductility of a ferrite phase in pearlite is lowered. "Sag resistance" is important for springs, and Si has the action of improving "sag resistance", but even if Si is contained in an amount of more than 2.5%, the effect is saturated and the cost is raised, and decarburization is promoted. Accordingly, the content of Si is preferably 0.1 to 2.5%.

Mn: 0.1 to 1.0%

Mn is an element effective for deoxidization, and if the content is less than 0.1%, this effect cannot be demonstrated. On the other hand, if Mn is contained excessively in an amount of more than 1.0%, segregation readily occurs and deteriorates cold workability and fatigue resistance. Accordingly, the content of Mn is preferably 0.1 to 1.0%.

Zr: 0.1% or less

Zr may not be added. If Zr is added, the average composition of the oxides described above can be controlled relatively easily in the desired range and further it has the action of making austenite grains fine and improving ductility and toughness. However, even if Zr is contained in an amount of more than 0.1%, the effect described above is saturated, and further the $ZrO_2$ content exceeds the range of $ZrO_2$ contained in the average composition of the oxides described above, which may lead to deterioration of cold workability and fatigue resistance. Accordingly, the content of Zr is preferably 0.1% or less. The lower limit of the Zr content refers to a value where the amount of $ZrO_2$ contained in the average composition of the oxides indicates 0.1%.

The steel as stock of the wire rod may further contain the following elements.

Cu: 0 to 0.5%

Cu may not be added. If added, Cu demonstrates the effect of improving corrosion resistance. To secure this effect, the content of Cu is preferably 0.1% or more. However, if Cu is contained in an amount of more than 0.5%, it is segregated on a grain boundary, and cracks and flaws occur significantly during bloom rolling of steel ingots or during hot rolling of wire rods. Accordingly, the Cu content is preferably 0 to 0.5%.

Ni: 0 to 1.5%

Ni may not be added. If added, Ni forms a solid solution in ferrite to exert the action of improving the toughness of ferrite. For securing this effect, the content of Ni is preferably 0.05% or more. However, if its content exceeds 1.5%, hardenability becomes too high, martensite is easily formed, and cold workability is deteriorated. Accordingly, the content of Ni is preferably 0 to 1.5%.

Cr: 0 to 1.5%

Cr may not be added. Cr has the action of reducing the lamellar spacing in pearlite, which increases strength after hot rolling and patenting. Further, it also has the action of increasing work hardening ratio during cold working, so addition of Cr can achieve high strength even at relatively low work ratio. Cr also has the action of improving corrosion resistance. To secure these effects, the content of Cr is preferably 0.1% or more. However, if the content exceeds 1.5%, hardenability toward pearlite transformation becomes too high so that patenting treatment becomes difficult. Accordingly, the content of Cr is preferably 0 to 1.5%.

Mo: 0 to 0.5%

Mo may not be added. If added, Mo has the action of being precipitated as fine carbides upon heat-treatment, which improves strength and fatigue resistance. To secure this effect, the content of Mo is preferably 0.1% or more. On the other hand, even if Mo is contained in an amount of more than 0.5%, the effect is saturated and high costs are merely brought about. Accordingly, the content of Mo is preferably 0 to 0.5%.

W: 0 to 0.5%

W may not be added. If added, W similar to Cr has the action of significantly improving work hardening ratio during cold working. To secure this effect, the content of W is preferably 0.1% or more. However, if the content exceeds 0.5%, hardenability of steel becomes too high so that patenting treatment is made difficult. Accordingly, the content of W is preferably 0 to 0.5%.

Co: 0 to 2.0%

Co may not be added. If added, Co has the effect of inhibiting the precipitation of proeutectoid cementite. To secure this effect, the content of Co is preferably 0.1 or more. On the other hand, even if Co is contained in an amount of more than 2.0%, the effect is saturated and high costs are merely brought about. Accordingly, the content of Co is preferably 0 to 2.0%.

B: 0 to 0.0030%

B may not be added. If added, B has the action of promoting growth of cementite in pearlite to improve the ductility of wire rods. To secure this effect, the content of B is preferably 0.0005% or more. However, if the content exceeds 0.0030%, cracks easily occur during warm and hot working. Accordingly, the content of B is preferably 0 to 0.0030%.

V: 0 to 0.5%

V may not be added. If added, V has the action of making austenite grains fine and improves ductility and toughness. To secure this effect, the content of V is preferably 0.05% or more. However, even if the content exceeds 0.5%, said effect is saturated and high costs are merely brought about. Accordingly, the content of V is preferably 0 to 0.5%.

Nb: 0 to 0.1%

Nb may not be added. If added, Nb has the action of making austenite grains fine and improves ductility and toughness. To secure this effect, the content of Nb is preferably 0.01% or more. However, even if the content exceeds 0.1%, said effect is saturated and high costs are merely brought about. Accordingly, the content of Nb is preferably 0 to 0.1 %.

Ti: 0 to 0.1%

Ti may not be added. If added, Ti has the action of making austenite grains fine and improves ductility and toughness. To secure this effect, the content of Ti is preferably 0.005% or more. However, if Ti is contained in an amount of more than 0.1%, said effect is saturated and high costs are merely brought about. Accordingly, the content of Ti is preferably 0 to 0.1%.

As impurity elements, the contents of P, S, Al, N and O (oxygen) are preferably restricted as follows:

P: 0.020% or less

P induces breakage during cold working, particularly during drawing. Particularly, if the content exceeds 0.020%, breakage occurs frequently during drawing. Accordingly, the content of P as an impurity is preferably 0.020% or less.

S: 0.020% or less

S induces breakage during cold working, particularly during drawing. Particularly, if the content exceeds 0.020%, breakage occurs frequently during drawing. Accordingly, the content of S as an impurity is preferably 0.020% or less.

Al: 0.005% or less

Al is a major element for forming oxides and it deteriorates fatigue resistance and cold workability. In particular, if the content exceeds 0.005%, the deterioration of fatigue resistance is significant. Accordingly, the content of Al as an impurity is preferably 0.005% or less, more preferably 0.004% or less.

N: 0.005% or less

N is an element forming nitrides and adversely affects ductility and toughness due to strain aging. In particular, if the content exceeds 0.005%, its adverse effect is significant. Accordingly, the content of N as an impurity is preferably 0.005% or less, more preferably 0.0035% or less.

O (oxygen): 0.0025% or less

If the content of 0 exceeds 0.0025%, the number and width of oxides are increased, and fatigue resistance is significantly deteriorated. Accordingly, the content of 0 as an impurity is preferably 0.0025% or less, more preferably 0.0020% or less.

Out of the stock steel having the chemical components described above, the chemical components in the stock steel suitable for use in springs and steel cords are shown below.

For use in springs, the chemical components in the steel preferably comprise, on the weight % basis, C, 0.45 to 0.70%; Si, 0.1 to 2.5%; Mn, 0.1 to 1.0%; Zr, 0.1% or less and further comprise Cu, 0 to 0.5%; Ni, 0 to 1.5%; Cr, 0 to 1.5%; Mo, 0 to 0.5%; W, 0 to 0.5%; Co, 0 to 1.0%; B, 0 to 0.0030%; V, 0 to 0.5%; Nb, 0 to 0.1%; and Ti, 0 to 0.1%, the balance is Fe and incidental impurities, and in the impurities P is 0.020% or less, S is 0.020% or less, Al is 0.005% or less, N is 0.005% or less and O (oxygen) is 0.0025% or less.

The chemical components in steel as described above can easily confer a tensile strength of 1600 MPa or more on springs after heat-treatment.

For use in steel cords, the chemical components in the steel preferably comprise, on the weight % basis, C, 0.60 to 1.1%; Si, 0.1 to 1.0%; Mn, 0.1 to 0.7%; Zr, 0.1% or less and further comprise Cu, 0 to 0.5%; Ni, 0 to 1.5%; Cr, 0 to 1.5%; Mo, 0 to 0.2%; W, 0 to 0.5%; Co, 0 to 2.0%; B, 0 to 0.0030%; V, 0 to 0.5%; Nb, 0 to 0.1%; and Ti, 0 to 0.1%, the balance is Fe and incidental impurities, and in the impurities P is 0.020% or less, S is 0.020% or less, Al is 0.005% or less, N is 0.005% or less and O (oxygen) is 0.0025% or less.

The chemical components in the steel described above can confer a high tensile strength of 3200 MPa or more on steel wires wet-drawn to 0.15 to 0.35 mm.

There is no particular limit to the specific process for producing the above steel serving as stock steel of wire rods excellent in fatigue resistance and cold workability. However, depending on the method of melting the steel and the method of casting the same, the chemical components in the steel, particularly the contents of impurities are changed, and the production costs of steel ingots are also changed depending on the casting method. Accordingly, the process for producing the steel serving as stock steel of wire rods, particularly the melting method and the casting method, may be specified as follows:

(D) Process of Steel Refining and Casting

The process of primary refining in a converter and secondary refining outside the converter is very effective for reduction of impurity elements in steel and is thus suitable for production of steel having high cleanliness, and further continuous casting into steel ingots can make the production cost relative low. Accordingly, the steel serving as stock steel for wire rods is formed into steel ingots preferably through the process of primary refining in a converter, secondary refining outside the converter and continuous casting. As used herein, the term "steel ingots" includes "continuously casted slabs" as defined as JIS terms. The "secondary refining" refers to what is usually called "refining outside a converter", which is "refining outside a converter for cleaning a steel" such as ladle refining having a gas bubbling or arc reheating process and refining using a vacuum treatment apparatus, as previously described.

Through the process of primary refining in a converter, secondary refining outside the converter and continuous casting in this order and by suitably regulating the "amount of mixed Al", the "amount of $Al_2O_3$ such as in flux", the "amount of $ZrO_2$ such as in flux", and the "final $CaO/SiO_2$ ratio", the "average composition" described above can be formed relatively easily into the composition comprising, on the weight % basis, $SiO_2$, 70% or more; $CaO+Al_2O_3$, less than 20%; and $ZrO_2$, 0.1 to 10%.

If the "amount of mixed Al" exceeds 10 g/ton, the amount of $Al_2O_3$ is increased so that the amount of $CaO+Al_2O_3$ contained in the "average composition" is 20% or more and further silicate inclusions are not finely dispersed, which may result in deterioration of cold workability. Accordingly, the "amount of mixed Al" is preferably not more than 10 g/ton. The "amount of mixed Al" described above is more preferably not more than 5 g/ton, most preferably not more than 3 g/ton.

If the "amount of $Al_2O_3$ such as in flux" exceeds 20%, the amount of Al in molten steel to be equilibrated with refractories and flux is increased, so the same change in the composition of oxides as in the case where the "amount of mixed Al" exceeds 10 g/ton, and cold workability may be deteriorated. The "amount of $Al_2O_3$ such as in flux" is preferably 20% or less. The "amount of $Al_2O_3$ such as in flux" is more preferably 10% or less.

If the "amount of $ZrO_2$ such as in flux" is less than 1%, the amount of $ZrO_2$ contained in the "average composition" is lower than the specified amount of 0.1%, and silicate inclusions become coarse and rigid inclusions which may cause breakage frequently during cold working. On the other hand, if the "amount of $ZrO_2$ such as in flux" exceeds 95%, refractories are made brittle and peeled off and chipped to remain in molten steel, and if the amount of $ZrO_2$ contained in the "average composition" described in item (B) above exceeds 10%, $ZrO_2$ inclusions become coarse and rigid inclusions which may cause breakage frequently during cold working. Accordingly, the "amount of $ZrO_2$ such as in flux" is preferably 1 to 95% to permit $ZrO_2$ to form a complex with silicate inclusions and to finely disperse silicate inclusions. The upper limit of the "amount of $ZrO_2$ such as in flux" described above is preferably 80%.

Production costs can be reduced by suitably regulating the "amount of $ZrO_2$ such as in flux" and by permitting $ZrO_2$ to form a complex with silicate inclusions indirectly via molten steel from refractories and flux, that is, by permitting $ZrO_2$ to form a complex with silicate inclusions via Zr in such an amount as to be equilibrated with refractories and flux.

Alternatively, metal Zr may be added to molten steel so that $ZrO_2$ is added to silicate inclusions whereby the silicate inclusions are finely dispersed, but this method results in higher production costs and can thus be uneconomical.

If the "final $CaO/SiO_2$ ratio" exceeds 2.0, rigid oxides such as spinel alumina may appear to reduce the cleanliness of steel. Accordingly, for stable production of stock steel having high cleanliness, the "final $CaO/SiO_2$ ratio" is preferably 2.0 or less. Given the upper limit of 2.0, the "final $CaO/SiO_2$ ratio" is preferably 0.3 or more, more preferably 0.6 or more and most preferably 0.8 or more.

To adjust the "final $CaO/SiO_2$ ratio" to 2.0 or less, the $CaO/SiO_2$ ratio may be constant without changing the $CaO/SiO_2$ ratio in each step of refining, or the "final $CaO/SiO_2$ ratio" may be adjusted from lower or higher values to 2.0 or less as necessary. The $CaO/SiO_2$ ratio can be controlled by suitably selecting flux blown into molten steel. For example, the $CaO/SiO_2$ ratio can be adjusted from lower values to the "final $CaO/SiO_2$ ratio" of 2.0 or less by blowing flux into molten steel uniformly where said flux contains CaO and simultaneously has a higher $CaO/SiO_2$ ratio than the $CaO/SiO_2$ ratio in slag in a ladle brought into contact with molten steel in the process of secondary refining and subsequent steps.

(E) Production of Wire Rods by Hot Rolling

It is not particularly necessary to specify hot rolling where the steel produced through the process of refining and casting described in item (D) above is formed into wire rods, and for example, conventionally conducted hot rolling can be applied.

(F) Cold Working of the Wire Rods, Final Heat-treatment, Plating, and Wet Drawing Cold working of the wire rods obtained by hot rolling may be conducted by conventional cold working such as drawing using a wire drawing die, by drawing using a roller die or by cold rolling using the so-called "2-roll rolling mill", "3-roll rolling mill" or "4-roll rolling mill". The final patenting treatment, i.e. "final heat-treatment" may also be conventionally conducted patenting treatment. The plating conducted for the purpose of reducing drawing resistance in the subsequent process of wet drawing or improving adhesion to rubber for use in steel cords may not be special and may be conventional brass plating, Cu plating and Ni plating. Further, the wet drawing may also be conventional one.

Fine steel wires produced by cold working of the wire rods, final heat-treatment, plating and wet drawing may also be formed into predetermined final products. For example, a plurality of the fine steel wires are further twisted into a twisted steel wire to produce a steel cord.

EXAMPLES

Hereinafter, the present invention is described in more detail by reference to the Examples, which however are not intended to limit the present invention.

Example 1

Steels A to W having the chemical compositions shown in Table 1 were produced in the process of primary refining in a converter, secondary refining outside the converter and continuous casting. That is, these steels were produced by melting in a 70-ton converter, subsequent deoxidization with Si and Mn at the time of tapping, and "secondary refining" for regulating the components (chemical composition) and for cleanliness treatment followed by continuous casting to form steel ingots. Table 1 shows the "amount of mixed Al" (that is, the amount of metal Al introduced into molten steel during the process of from primary refining in a converter to continuous casting or the amount of metal Al mixed as an incidental impurity) in melting in the converter and "secondary refining", the "amount of $Al_2O_3$ such as in flux" (that is, the amount of $Al_2O_3$ in flux and refractories in contact with molten steel), the "amount of $ZrO_2$ such as in flux" (that is, the amount of $ZrO_2$ contained in at least one of said refractories and flux), the presence or absence of blowing of flux into molten steel, the $CaO/SiO_2$ ratio in slag in a ladle during refining, and the "final $CaO/SiO_2$ ratio" (that is, the final $CaO/SiO_2$ ratio in slag in a ladle in contact with molten steel in the process of secondary refining and subsequent steps). The flux blown into molten steel is specifically a powder of CaO or a mixed powder of CaO and $SiO_2$.

Steels A to W in Table 1 are those corresponding to JIS SWRS82A usually used as stock steel for steel cords. In Table 1, the contents of C, Si, Mn, P, S as standard chemical components under JIS as well as the contents of impurity elements Al, N and O (oxygen) are shown.

The respective steels after continuous casting were hot-rolled into wire rods of 5.5 mm in diameter while the rolling temperature and cooling rate were controlled in a usual manner. These wire rods were subjected to primary drawing (finish diameter: 2.8 mm), primary patenting treatment and secondary drawing (finish diameter: 1.2 mm). Thereafter, these rods were subjected to final patenting treatment (austenitizing temperature of 950 to 1050° C., and a lead bath temperature of 560 to 610° C.) and subsequently to brass plating, followed by wet drawing (finish diameter: 0.2 mm) at a drawing rate of 550 m/min.

An L section of a wire rod of 5.5 mm in diameter was polished, and its polished face was analyzed by an EPMA apparatus. The measurement result of the composition of oxides of 2 μm or more in width, as well as index of breakage (number of breakages per ton of steel wire (number/ton)) when a steel wire of 1.2 mm in diameter was wetdrawn to a steel wire of 0.2 mm in diameter, is shown in Table 2. The "average composition" in Table 2 refers to the average composition of oxides of 2 μm or more in width on the L section of the wire rod, as described above, and this applies in the Examples below.

TABLE 1

| Test | | Chemical composition (weight %) The balance: Fe and impurities | | | | | | | | Amount of mixed Al | Amount of $Al_2O_3$ such as | Amount of $ZrO_2$ such as | Blowing | $CaO/SiO_2$ ratio | |
|---|---|---|---|---|---|---|---|---|---|---|---|---|---|---|---|
| No. | Steel | C | Si | Mn | P | S | Al | N | O | (g/ton) | in flux (%) | in flux (%) | of flux | Before blowing of flux | Final |
| 1 | A | 0.81 | 0.21 | 0.53 | 0.012 | 0.011 | 0.002 | 0.0031 | 0.0018 | 8 | 5 | 80 | None | — | 1.5 |
| 2 | B | 0.81 | 0.21 | 0.51 | 0.008 | 0.007 | 0.001 | 0.0029 | 0.0019 | 3 | 5 | 80 | None | — | 1.5 |
| 3 | C | 0.81 | 0.21 | 0.49 | 0.008 | 0.009 | 0.001 | 0.0027 | 0.0016 | 1 | 5 | 80 | None | — | 1.5 |
| 4 | D | 0.81 | 0.19 | 0.49 | 0.012 | 0.011 | 0.001 | 0.0038 | 0.0015 | 1 | 3 | 80 | None | — | 1.5 |
| 5 | E | 0.81 | 0.21 | 0.52 | 0.012 | 0.011 | 0.001 | 0.0032 | 0.0017 | 1 | 18 | 80 | None | — | 1.5 |
| 6 | F | 0.81 | 0.21 | 0.53 | 0.012 | 0.011 | 0.001 | 0.0026 | 0.0014 | 1 | 5 | 80 | None | — | 2.0 |
| 7 | G | 0.81 | 0.21 | 0.51 | 0.008 | 0.007 | 0.001 | 0.0041 | 0.0016 | 1 | 5 | 80 | None | — | 0.8 |
| 8 | H | 0.81 | 0.21 | 0.49 | 0.008 | 0.009 | 0.001 | 0.0033 | 0.0012 | 1 | 5 | 80 | None | — | 0.6 |
| 9 | I | 0.81 | 0.19 | 0.49 | 0.012 | 0.011 | 0.001 | 0.0028 | 0.0013 | 1 | 5 | 0.30 | None | — | 1.5 |
| 10 | J | 0.81 | 0.21 | 0.52 | 0.012 | 0.011 | 0.001 | 0.0035 | 0.0011 | 1 | 5 | 90 | None | — | 1.5 |
| 11 | K | 0.81 | 0.21 | 0.53 | 0.012 | 0.011 | 0.001 | 0.0026 | 0.0018 | 1 | 5 | 80 | None | 1.5 | 1.5 |
| 12 | L | 0.81 | 0.21 | 0.51 | 0.008 | 0.007 | 0.001 | 0.0033 | 0.0020 | 1 | 5 | 80 | Present | 1.5 | 1.5 |
| 13 | M | 0.81 | 0.21 | 0.49 | 0.008 | 0.009 | 0.001 | 0.0030 | 0.0013 | 1 | 5 | 80 | None | 2.5 | 1.5 |
| 14 | N | 0.81 | 0.20 | 0.51 | 0.010 | 0.009 | 0.001 | 0.0025 | 0.0012 | 1 | 5 | 80 | None | 0.8 | 1.5 |
| 15 | O | 0.81 | 0.20 | 0.51 | 0.010 | 0.009 | 0.001 | 0.0034 | 0.0010 | 1 | 5 | 80 | Present | 2.5 | 1.5 |
| 16 | P | 0.81 | 0.19 | 0.49 | 0.012 | 0.011 | 0.001 | 0.0024 | 0.0014 | 1 | 5 | 80 | Present | 0.8 | 1.5 |
| 17 | Q | 0.81 | 0.20 | 0.51 | 0.010 | 0.009 | 0.011 | 0.0128 | 0.0011 | 50 | 5 | 80 | None | — | 1.5 |
| 18 | R | 0.81 | 0.20 | 0.51 | 0.010 | 0.009 | 0.007 | 0.0027 | 0.0011 | 13 | 5 | 80 | None | — | 1.5 |
| 19 | S | 0.81 | 0.21 | 0.50 | 0.009 | 0.0008 | 0.001 | 0.0030 | 0.0013 | 1 | 23 | 80 | None | — | 1.5 |
| 20 | T | 0.81 | 0.21 | 0.52 | 0.011 | 0.012 | 0.001 | 0.0026 | 0.0012 | 1 | 85 | 80 | None | — | 1.5 |
| 21 | U | 0.81 | 0.20 | 0.51 | 0.010 | 0.009 | 0.001 | 0.0031 | 0.0015 | 1 | 5 | 80 | None | — | 3.0 |
| 22 | V | 0.81 | 0.21 | 0.50 | 0.009 | 0.0008 | 0.001 | 0.0029 | 0.0017 | 1 | 5 | — | None | — | 1.5 |
| 23 | W | 0.81 | 0.21 | 0.50 | 0.009 | 0.0008 | 0.001 | 0.0025 | 0.0018 | 1 | 5 | 96 | None | — | 1.5 |

In Test Nos. 11, 13 and 14, the $CaO/SiO_2$ in a ladle measured at the same timing as blowing of flux is expressed as $CaO/SiO_2$ ratio before blowing of flux.

TABLE 2

| | | Average composition (%) | | | | Index of breakage |
|---|---|---|---|---|---|---|
| Test No. | Steel | $SiO_2$ | $CaO + Al_2O_3$ | $ZrO_2$ | Others | (time/ton) |
| 1 | A | 73.3 | 18.1 | 5.2 | 3.4 | 0.1 |
| 2 | B | 78.4 | 16.3 | 1.3 | 4.0 | 0.2 |
| 3 | C | 82.2 | 11.2 | 2.1 | 4.5 | 0.1 |
| 4 | D | 79.1 | 9.6 | 1.9 | 9.4 | 0 |
| 5 | E | 72.5 | 18.8 | 6.7 | 2.0 | 0.1 |
| 6 | F | 73.6 | 18.2 | 5.6 | 2.6 | 0.1 |
| 7 | G | 78.7 | 16.5 | 1.5 | 3.3 | 0.2 |
| 8 | H | 82.3 | 11.9 | 2.1 | 3.7 | 0 |
| 9 | I | 79.2 | 14.0 | 1.0 | 5.8 | 0.2 |
| 10 | J | 72.0 | 15.7 | 9.1 | 3.2 | 0.1 |
| 11 | K | 73.5 | 18.2 | 5.6 | 2.7 | 0.1 |
| 12 | L | 78.7 | 16.3 | 1.8 | 3.2 | 0.1 |
| 13 | M | 82.3 | 11.2 | 2.7 | 3.8 | 0.1 |
| 14 | N | 77.1 | 10.5 | 2.2 | 0.2 | 0.2 |
| 15 | O | 71.0 | 17.2 | 3.6 | 8.2 | 0.1 |
| 16 | P | 84.4 | 9.0 | 1.5 | 5.1 | 0.1 |
| 17 | Q | *24.1 | *62.0 | 2.9 | 1.0 | 5.3 |
| 18 | R | *58.2 | *24.3 | 5.1 | 2.4 | 1.2 |
| 19 | S | 70.3 | *21.2 | 2.8 | 5.7 | 0.8 |
| 20 | T | *35.4 | *53.5 | 1.7 | 9.4 | 2.3 |

TABLE 2-continued

| Test No. | Steel | Average composition (%) $SiO_2$ | $CaO + Al_2O_3$ | $ZrO_2$ | Others | Index of breakage (time/ton) |
|---|---|---|---|---|---|---|
| 21 | U | *40.5 | *50.3 | 3.6 | 5.6 | 6.8 |
| 22 | V | 75.6 | 15.7 | *— | 8.7 | 0.1 |
| 23 | W | 70.7 | 14.2 | *13.2 | 1.9 | 9.4 |

The symbol "*" means that the content fails to satisfy the conditions specified in the invention.

From Table 2, it is evident that because the average compositions of steel wire rods in Test Nos. 1 to 16, that is, wire rods made of steels A to P as stock steels produced by the method described in Table 1 satisfy the conditions specified in the present invention, the steel wires have a low index of breakage and are excellent in drawing workability. On the other hand, the average compositions of steel rods made of steels Q to W as stock steels in Test Nos. 17 to 23 are outside of the conditions specified in the present invention, and the steel wires have a high index of breakage and are inferior in drawing workability.

Example 2

Steels A1 to A15 shown in Table 3 were produced in the process of primary refining in a converter, secondary refining outside the converter and continuous casting. That is, they were produced by melting in a converter, subsequent deoxidization with Si and Mn at the time of tapping and "secondary refining" for regulating the components (chemical composition) and for cleanliness treatment while the "amount of mixed Al" was adjusted to 1 g/ton, the "amount of $Al_2O_3$ such as in flux" to 5%, the "amount of $ZrO_2$ such as in flux" to 90%, and the "final $CaO/SiO_2$ ratio" to 1.0, followed by continuous casting.

TABLE 3

| Steel | Chemical composition (weight %) The balance: Fe and impurities C | Si | Mn | P | S | Al | N | O | Others |
|---|---|---|---|---|---|---|---|---|---|
| A1 | 0.77 | 0.20 | 0.40 | 0.005 | 0.004 | 0.001 | 0.0028 | 0.0020 | — |
| A2 | 0.84 | 0.18 | 0.42 | 0.006 | 0.005 | 0.001 | 0.0029 | 0.0017 | Cu: 0.13 |
| A3 | 0.93 | 0.21 | 0.34 | 0.004 | 0.004 | 0.001 | 0.0031 | 0.0018 | Cr: 0.15, Co: 0.10, B: 0.0010 |
| A4 | 0.92 | 0.23 | 0.37 | 0.005 | 0.006 | 0.001 | 0.0027 | 0.0019 | Ni: 0.10 |
| A5 | 0.93 | 0.19 | 0.41 | 0.007 | 0.004 | 0.001 | 0.0021 | 0.0018 | Cr: 0.15, Zr: 0.07 |
| A6 | 0.91 | 0.30 | 0.31 | 0.005 | 0.005 | 0.001 | 0.0024 | 0.0019 | V: 0.10, Ti: 0.005 |
| A7 | 0.95 | 0.19 | 0.37 | 0.005 | 0.004 | 0.001 | 0.0025 | 0.0017 | Mo: 0.15, W: 0.25 |
| A8 | 1.00 | 0.18 | 0.34 | 0.006 | 0.004 | 0.001 | 0.0022 | 0.0018 | Nb: 0.02 |
| A9 | 1.01 | 0.19 | 0.40 | 0.004 | 0.003 | 0.001 | 0.0024 | 0.0019 | Cu: 0.1, Zr: 0.03 |
| A10 | 1.03 | 0.20 | 0.34 | 0.007 | 0.003 | 0.001 | 0.0024 | 0.0021 | Co: 1.0, B: 0.0020 |
| A11 | 1.08 | 0.12 | 0.51 | 0.004 | 0.004 | 0.001 | 0.0025 | 0.0018 | — |
| A12 | 1.07 | 0.82 | 0.12 | 0.005 | 0.006 | 0.001 | 0.0021 | 0.0019 | — |
| A13 | 1.04 | 0.41 | 0.29 | 0.006 | 0.005 | 0.001 | 0.0030 | 0.0019 | Cr: 0.5, Ni: 0.1 |
| A14 | 1.03 | 0.38 | 0.40 | 0.005 | 0.004 | 0.001 | 0.0031 | 0.0017 | Co: 2.0, Cr: 0.3 |
| A15 | 1.05 | 0.18 | 0.35 | 0.009 | 0.004 | 0.001 | 0.0027 | 0.0021 | V: 0.13, Nb: 0.01 |

The respective steels after continuous casting were hot-rolled into wire rods of 5.5 mm in diameter while the rolling temperature and cooling rate were controlled in a usual manner. These wire rods were subjected to primary drawing (finish diameter: 2.8 mm), primary patenting treatment, and secondary drawing (finish diameter: 1.2 mm). Thereafter, these rods were subjected to final patenting treatment (austenitizing temperature of 950 to 1050° C., and a lead bath temperature of 560 to 610° C.) and subsequently to brass plating, followed by wet drawing (finish diameter: 0.2 mm) at a drawing rate of 550 m/min.

An L section of a wire rod of 5.5 mm in diameter was polished, and its polished face was analyzed by an EPMA apparatus. The measurement result of the composition of oxides of 2 $\mu$m or more in width, as well as the index of breakage when a steel wire of 1.2 mm in diameter was wet-drawn to a steel wire of 0.2 mm in diameter, is shown in Table 4.

TABLE 4

| Test No. | Steel | Average composition (%) $SiO_2$ | $CaO + Al_2O_3$ | $ZrO_2$ | Others | Index of breakage (time/ton) |
|---|---|---|---|---|---|---|
| 24 | A1 | 72.5 | 7.5 | 0.3 | 19.7 | 0.1 |
| 25 | A2 | 76.3 | 13.3 | 0.2 | 10.2 | 0.2 |
| 26 | A3 | 70.5 | 8.4 | 1.5 | 19.6 | 0.2 |
| 27 | A4 | 78.5 | 17.3 | 3.3 | 0.9 | 0.1 |
| 28 | A5 | 83.4 | 5.1 | 2.0 | 9.5 | 0.1 |
| 29 | A6 | 71.0 | 3.3 | 9.8 | 15.9 | 0.1 |
| 30 | A7 | 73.8 | 11.1 | 0.1 | 15.0 | 0.1 |
| 31 | A8 | 81.1 | 16.4 | 2.9 | 0.4 | 0.1 |
| 32 | A9 | 79.3 | 7.8 | 7.4 | 5.5 | 0.2 |
| 33 | A10 | 85.1 | 10.7 | 0.4 | 3.8 | 0.1 |
| 34 | A11 | 72.3 | 15.3 | 5.7 | 6.7 | 0.2 |
| 35 | A12 | 74.2 | 12.4 | 9.3 | 4.1 | 0.1 |
| 36 | A13 | 70.3 | 18.1 | 3.1 | 8.5 | 0.2 |
| 37 | A14 | 80.1 | 0.7 | 8.5 | 10.7 | 0.1 |
| 38 | A15 | 72.0 | 19.6 | 0.9 | 7.5 | 0.1 |

From Table 4, it is evident that because the average compositions of any rods made of steels A1 to A15 as stock steels produced in the method described above satisfy the conditions specified in the present invention, the resulting steel wires have a low index of breakage and are excellent in drawing workability.

Example 3

Steels 1 to 7 with the chemical compositions shown in Table 5 were produced in the process of primary refining in a converter, secondary refining outside the converter and continuous casting. That is, they were produced by melting in a converter, subsequent deoxidization with Si and Mn at the time of tapping and "secondary refining" for regulating the components (chemical composition) and for cleanliness treatment while the "amount of mixed Al" was adjusted to not more than 5 g/ton, the "amount of $Al_2O_3$ such as in flux" to not more than 10%, the "amount of $ZrO_2$ such as in flux" to 1 to 80%, and the "final $CaO/SiO_2$ ratio" to 0.8 to 2.0, followed by continuous casting.

TABLE 5

| Steel | Chemical composition (weight %) The balance: Fe and impurities | | | | | | | | |
|---|---|---|---|---|---|---|---|---|---|
| | C | Si | Mn | P | S | Al | N | O | Others |
| 1 | 0.75 | 0.23 | 0.39 | 0.005 | 0.002 | 0.001 | 0.0028 | 0.0017 | — |
| 2 | 0.78 | 0.20 | 0.41 | 0.008 | 0.004 | 0.001 | 0.0031 | 0.0018 | — |
| 3 | 0.90 | 0.20 | 0.54 | 0.004 | 0.004 | 0.001 | 0.0030 | 0.0018 | Cr: 0.06 |
| 4 | 0.95 | 0.21 | 0.51 | 0.007 | 0.004 | 0.001 | 0.0033 | 0.0019 | — |
| 5 | 1.02 | 0.19 | 0.35 | 0.006 | 0.005 | 0.001 | 0.0030 | 0.0018 | Cr: 0.05, Co: 0.06, B: 0.0011 |
| 6 | 0.95 | 0.20 | 0.41 | 0.005 | 0.003 | 0.001 | 0.0029 | 0.0019 | V: 0.05, Cu: 0.04, B: 0.0030 |
| 7 | 0.82 | 0.19 | 0.39 | 0.007 | 0.005 | 0.001 | 0.0027 | 0.0018 | Cr: 0.21, Co: 1.9, Ni: 0.07 |

The respective steels after continuous casting were hot-rolled into wire rods of 5.5 mm in diameter while the rolling temperature and cooling rate were controlled in a usual manner. These wire rods were subjected to primary drawing (finish diameter: 2.8 mm), primary patenting treatment, and secondary drawing (finish diameter: 1.2 mm). Thereafter, these rods were further subjected to final patenting treatment (austenitizing temperature of 950 to 1050° C., and a lead bath temperature of 560 to 610° C.) and subsequently to brass plating, followed by wet drawing (finish diameter: 0.2 mm) at a drawing rate of 550 m/min.

An L section of a wire rod of 5.5 mm in diameter was polished, and its polished face was analyzed by an EPMA apparatus. The measurement result of the composition of oxides of 2 $\mu$m or more in width, as well as the tensile strength and fatigue strength of a 0.2 mm steel wire and index of breakage when a steel wire of 1.2 mm in diameter was wet-drawn to a steel wire of 0.2 mm in diameter, is shown in Table 6. The fatigue strength is the result of a $10^7$ cycle test using a Hunter type rotating bending fatigue tester under the conditions of a temperature of 20 to 25° C. and a humidity of 50 to 60%.

TABLE 6

| Steel | Average composition (%) | | | | 0.2 mm steel wire | | |
|---|---|---|---|---|---|---|---|
| | $SiO_2$ | $CaO + Al_2O_3$ | $ZrO_2$ | Others | Tensile strength (MPa) | Fatigue strength (MPa) | Index of break-age (time/ton) |
| 1 | 72.5 | 10.3 | 1.1 | 16.1 | 3080 | 920 | 0.2 |
| 2 | 79.6 | 9.5 | 0.3 | 10.6 | 3170 | 950 | 0.1 |

TABLE 6-continued

| Steel | Average composition (%) | | | | 0.2 mm steel wire | | |
|---|---|---|---|---|---|---|---|
| | $SiO_2$ | $CaO + Al_2O_3$ | $ZrO_2$ | Others | Tensile strength (MPa) | Fatigue strength (MPa) | Index of break-age (time/ton) |
| 3 | 87.2 | 5.0 | 5.5 | 2.3 | 3720 | 1110 | 0.2 |
| 4 | 79.1 | 13.0 | 1.2 | 6.7 | 4030 | 1200 | 0.1 |
| 5 | 70.9 | 17.9 | 9.7 | 1.5 | 4280 | 1280 | 0.1 |
| 6 | 78.2 | 3.9 | 3.5 | 14.4 | 4100 | 1230 | 0.1 |
| 7 | 89.5 | 2.3 | 7.1 | 1.1 | 4170 | 1240 | 0.1 |

From Table 6, it is evident that because the average compositions of any wire rods made of steels 1 to 7 as stock steels produced in the method described above satisfy the conditions specified in the present invention, the resulting fine steel wires have high fatigue strength and a low index of breakage and are excellent in drawing workability.

Example 4

Steels 8 to14 with the chemical compositions shown in Table 7 were produced in the process of primary refining in a converter, secondary refining outside the converter and continuous casting. That is, they were produced by melting in a converter, subsequent deoxidization with Si and Mn at the time of tapping and "secondary refining" for regulating the components (chemical composition) and for cleanliness treatment while the "amount of mixed Al" was adjusted to not more than 5 g/ton, the "amount of $Al_2O_3$ such as in flux" to not more than 10%, the "amount of $ZrO_2$ such as in flux" to 1 to 80%, and the "final $CaO/SiO_2$ ratio" to 0.8 to 2.0, followed by continuous casting.

TABLE 7

| Steel | Chemical composition (weight %) The balance: Fe and impurities | | | | | | | | |
|---|---|---|---|---|---|---|---|---|---|
| | C | Si | Mn | P | S | Al | N | O | Others |
| 8 | 0.78 | 0.20 | 0.41 | 0.007 | 0.004 | 0.001 | 0.0030 | 0.0018 | — |
| 9 | 0.77 | 0.21 | 0.40 | 0.006 | 0.005 | 0.001 | 0.0032 | 0.0017 | — |
| 10 | 0.91 | 0.21 | 0.55 | 0.005 | 0.004 | 0.001 | 0.0031 | 0.0019 | Cu: 0.05 |
| 11 | 0.95 | 0.20 | 0.53 | 0.008 | 0.005 | 0.001 | 0.0034 | 0.0018 | — |
| 12 | 0.97 | 0.20 | 0.55 | 0.007 | 0.006 | 0.001 | 0.0031 | 0.0020 | Cr: 0.04, Co: 0.05, B: 0.0010 |
| 13 | 0.97 | 0.19 | 0.43 | 0.005 | 0.004 | 0.001 | 0.0028 | 0.0018 | W: 0.05, V: 0.05, B: 0.0012 |
| 14 | 0.83 | 0.20 | 0.31 | 0.004 | 0.004 | 0.001 | 0.0027 | 0.0017 | Cr: 0.20, Co: 2.0, Ni: 0.1 |

The respective steels after continuous casting were hot-rolled into wire rods of 5.5 mm in diameter while the rolling temperature and cooling rate were controlled in a usual manner. These wire rods were subjected to primary drawing (finish diameter: 2.8 mm), primary patenting treatment, and secondary drawing (finish diameter: 1.2 mm). Thereafter, these rods were further subjected to final patenting treatment (austenitizing temperature of 950 to 1050° C., and a lead bath temperature of 560 to 610° C.) and subsequently to brass plating, followed by wet drawing (finish diameter: 0.2 mm) at a drawing rate of 550 m/min.

An L section of a wire rod of 5.5 mm in diameter was polished, and its polished face was analyzed by an EPMA apparatus. The measurement result of the composition of oxides of 2 μm or more in width, as well as the tensile strength and fatigue strength of a 0.2 mm steel wire and index of breakage when a steel wire of 1.2 mm in diameter was wet-drawn to a steel wire of 0.2 mm in diameter, is shown in Table 8. In this Example, the oxides of 2 μm or more in width on the L section of the wire rod were defined as $SiO_2$, CaO, $Al_2O_3$, MgO, MnO and $ZrO_2$, and the sum of the "average composition" in said hexamerous oxide system was assumed to be 100%, and this "average composition" was examined. The fatigue strength is the result of a $10^7$ cycle test using a Hunter type rotating bending fatigue tester under the conditions of a temperature of 20 to 25° C. and a humidity of 50 to 60%.

TABLE 8

| | Average composition (%) | | | | | 0.2 mm steel wire | | Index of breakage |
|---|---|---|---|---|---|---|---|---|
| Steel | $SiO_2$ | CaO + $Al_2O_3$ | MgO | MnO | $ZrO_2$ | Tensile strength (MPa) | Fatigue strength (MPa) | (time/ton) |
| 8 | 73.2 | 8.3 | 4.2 | 5.1 | 9.2 | 3180 | 960 | 0.1 |
| 9 | 80.5 | 10.5 | 3.3 | 4.5 | 1.2 | 3140 | 940 | 0.1 |
| 10 | 93.2 | 1.0 | 0.8 | 3.1 | 1.9 | 3890 | 1200 | 0.1 |
| 11 | 84.1 | 13.2 | 1.3 | 1.1 | 0.3 | 4050 | 1230 | 0.2 |
| 12 | 71.3 | 18.3 | 3.4 | 2.9 | 4.1 | 4130 | 1240 | 0.1 |
| 13 | 78.2 | 13.5 | 1.4 | 6.1 | 0.8 | 4140 | 1260 | 0.2 |
| 14 | 89.0 | 3.1 | 1.3 | 3.3 | 3.3 | 4200 | 1200 | 0.1 |

From Table 8, it is evident that because the average compositions of any wire rods made of steels 8 to 14 as stock steels produced in the method described above satisfy the conditions specified in the present invention, the resulting fine steel wires have high fatigue strength and a low index of breakage and are excellent in drawing workability.

Example 5

The steels with the chemical compositions shown in Table 9 were molten in a testing furnace, deoxidized with Si and Mn and then subjected to secondary refining, and the amount of metal Al introduced into molten steel or the amount of metal Al mixed as an incidental impurity (hereinafter also referred to simply as the "amount of mixed Al") in the process of from refining in the testing furnace to continuous casting, the amount of $Al_2O_3$ in flux and refractories in contact with molten steel (hereinafter also referred to simply as the "amount of $Al_2O_3$ such as in flux"), the amount of $ZrO_2$ contained in at least one of said refractories and flux (hereinafter also referred to simply as the "amount of $Zro_2$ such as in flux") and the "final $CaO/SiO_2$ ratio" (that is, the final $CaO/SiO_2$ ratio in slag in a ladle in contact with molten steel in the process of secondary refining and subsequent steps) were varied such that the compositions of oxides were changed, followed by continuous casting.

In the production of steels 15 to 20 in Table 9, the amount of mixed Al was adjusted to not more than 5 g/ton, while the amount of $Al_2O_3$ such as in flux was adjusted to not more than 10% and the amount of $ZrO_2$ such as in flux was adjusted to 1 to 80% and further the final $CaO/SiO_2$ ratio was adjusted to the range of 0.8 to 2.0, followed by continuous casting. As opposed to the conditions described above, in the production of steels 21 to 26, at least one variable selected from the amount of mixed Al, the amount of $Al_2O_3$ such as in flux, the amount of $ZrO_2$ such as in flux and the final $CaO/SiO_2$ ratio was changed. Specifically, in steel 21, the final $CaO/SiO_2$ ratio was adjusted to 2.2. In steel 22, the amount of $ZrO_2$ such as in flux was adjusted to 0.9%.

TABLE 9

| | Chemical composition (weight %) The balance: Fe and impurities | | | | | | | | | Average composition (%) | | | | 0.2 mm steel wire | |
|---|---|---|---|---|---|---|---|---|---|---|---|---|---|---|---|
| Steel | C | Si | Mn | P | S | AI | N | O | Others | $SiO_2$ | CaO + $Al_2O_3$ | $ZrO_2$ | Others | Tensile strength (MPa) | Fatigue strength (MPa) |
| 15 | 0.91 | 0.21 | 0.29 | 0.006 | 0.004 | 0.001 | 0.0031 | 0.0021 | Cu: 0.2, Ni: 1.1 | 88.0 | 4.4 | 3.4 | 4.2 | 4101 | 1220 |
| 16 | 0.77 | 0.15 | 0.41 | 0.006 | 0.006 | 0.002 | 0.0045 | 0.0023 | W: 0.3, B: 0.0030 | 92.1 | 4.5 | 0.1 | 3.3 | 3351 | 980 |
| 17 | 0.85 | 0.93 | 0.14 | 0.011 | 0.017 | 0.004 | 0.0024 | 0.0013 | Co: 1.8, Nb: 0.03 | 81.0 | 2.2 | 0.5 | 16.3 | 3802 | 1120 |
| 18 | 0.96 | 0.12 | 0.30 | 0.006 | 0.005 | 0.001 | 0.0019 | 0.0014 | Cr: 1.2, Mo: 0.05 | 74.0 | 17.5 | 3.1 | 5.4 | 4260 | 1260 |
| 19 | 0.61 | 0.13 | 0.49 | 0.007 | 0.008 | 0.001 | 0.0030 | 0.0020 | Cu: 0.2, B: 0.0007, Ti: 0.03 | 84.2 | 5.2 | 5.0 | 5.6 | 3205 | 950 |
| 20 | 0.83 | 0.22 | 0.11 | 0.010 | 0.005 | 0.002 | 0.0022 | 0.0018 | Zr: 0.04, Cu: 0.3 | 93.8 | 0.9 | 0.9 | 4.4 | 3910 | 1150 |
| 21 | 0.92 | 0.21 | 0.29 | 0.006 | 0.005 | 0.001 | 0.0031 | 0.0021 | Cu: 0.2, Ni: 1.1 | 71.8 | *21.9 | 0.4 | 5.9 | 4115 | 810 |
| 22 | 0.78 | 0.16 | 0.40 | 0.006 | 0.007 | 0.002 | 0.0044 | 0.0022 | W: 0.3, B: 0.0029 | 77.7 | 13.2 | *0 | 9.1 | 3360 | 650 |
| 23 | 0.85 | 0.93 | 0.13 | 0.011 | 0.015 | 0.004 | 0.0022 | 0.0014 | Co: 1.8, Nb: 0.03 | *65.7 | 11.2 | *0 | 23.1 | 3825 | 750 |
| 24 | 0.95 | 0.12 | 0.29 | 0.005 | 0.006 | 0.001 | 0.0018 | 0.0014 | Cr: 1.2, Mo: 0.05 | *44.8 | *45.1 | *0 | 10.1 | 4243 | 830 |
| 25 | 0.62 | 0.13 | 0.50 | 0.007 | 0.009 | 0.001 | 0.0031 | 0.0022 | Cu: 0.2, B: 0.0008, Ti: 0.03 | *51.5 | *27.9 | *11.2 | 9.4 | 3219 | 640 |
| 26 | 0.82 | 0.23 | 0.12 | 0.009 | 0.004 | 0.002 | 0.0022 | 0.0018 | Zr: 0.04, Cu: 0.3 | *13.4 | *77.2 | 1.0 | 8.4 | 3923 | 730 |

The symbol "*" means that the content fails to satisfy the conditions specified in the invention.

In steel 23, the amount of $ZrO_2$ such as in flux was adjusted to 0.8%, and the final $CaO/SiO_2$ ratio was adjusted to 0.6. In steel 24, the amount of $ZrO_2$ such as in flux was adjusted to 0.8%, and the final $CaO/SiO_2$ ratio was adjusted to 2.1. In steel 25, the amount of $ZrO_2$ such as in flux was adjusted to 81%, and the final $CaO/SiO_2$ ratio was adjusted to 2.3. In steel 26, the amount of mixed Al was 7 g/ton, and the amount of $Al_2O_3$ such as in flux was adjusted to 11%, and further the final $CaO/SiO_2$ ratio was adjusted to 2.1. Steels 15 and 21, steels 16 and 22, steels 17 and 23, steels 18 and 24, steels 19 and 25, and steels 20 and 26 were adjusted to have almost similar chemical compositions.

The respective steels after continuous casting as described above were hot-rolled into wire rods of 5.5 mm in diameter while the rolling temperature and cooling rate were controlled in a usual manner. These wire rods were subjected to primary drawing (finish diameter: 2.8 mm), primary patenting treatment, and secondary drawing (finish diameter: 1.2 mm). Thereafter, these rods were further subjected to final patenting treatment (austenitizing temperature of 950 to 1050° C., and a lead bath temperature of 560 to 610° C.) and subsequently to brass plating, followed by wet drawing (finish diameter: 0.2 mm) at a drawing rate of 550 m/min.

An L section of a wire rod of 5.5 mm in diameter was polished, and its polished face was analyzed by an EPMA apparatus. The measurement result of the composition of oxides of 2 $\mu$m or more in width, as well as the tensile strength and fatigue strength of a 0.2 mm steel wire, is shown in Table 9. The fatigue strength is the result of a $10^7$ cycle test using a Hunter type rotating bending fatigue tester under the conditions of a temperature of 20 to 25° C. and a humidity of 50 to 60%.

From Table 9, it is evident that because the average compositions of the fine steel wires produced from wire rods made of steels 15 to 20 as stock steels satisfy the conditions specified in the present invention, they have higher fatigue strength than that of the fine steel wires produced from wire rods made of steels 21 to 26 as stock steels outside the conditions specified in the present invention.

Table 10 shows the index of breakage of each steel (number of breakages per ton of steel wire (number/ton)) when a steel wire of 1.2 mm in diameter was wet-drawn to a steel wire of 0.2 mm in diameter.

TABLE 10

| Steel | Index of breakage (time/ton) |
|---|---|
| 15 | 0.2 |
| 16 | 0.1 |

TABLE 10-continued

| Steel | Index of breakage (time/ton) |
|---|---|
| 17 | 0.2 |
| 18 | 0.2 |
| 19 | 0.2 |
| 20 | 0.1 |
| 21 | 13.0 |
| 22 | 5.2 |
| 23 | 15.2 |
| 24 | 10.2 |
| 25 | 15.7 |
| 26 | 17.5 |

From Table 10, it is evident that because the average compositions of wire rods made of steels 15 to 20 as stock steels satisfy the conditions specified in the present invention, the resulting steel wires have a low index of breakage and are excellent in drawing workability. On the other hand, the average compositions of wire rods made of steels 21 to 26 as stock steels do not fall under the conditions specified in the present invention, and the resulting steel wires have a high index of breakage and are inferior in drawing workability.

Example 6

Steels having the chemical compositions shown in Table 11 were molten in a testing furnace, deoxidized with Si and Mn and then subjected to secondary refining, and the "amount of mixed Al", the "amount of $Al_2O_3$ such as in flux", the "amount of $ZrO_2$ such as in flux" and the "final $CaO/SiO_2$ ratio" were varied such that the compositions of oxides were changed variously, followed by continuous casting.

In the production of steels 27 to 32 in Table 11, the amount of mixed Al was adjusted to not more than 5 g/ton, while the amount of $Al_2O_3$ such as in flux was adjusted to not more than 10% and the amount of $ZrO_2$ such as in flux was adjusted to 1 to 80% and further the final $CaO/SiO_2$ ratio was adjusted to the range of 0.8 to 2.0, followed by continuous casting. As opposed to the conditions described above, in the production of steels 33 to 38, at least one variable selected from the amount of mixed Al, the amount of $Al_2O_3$ such as in flux, the amount of $ZrO_2$ such as in flux and the final $CaO/SiO_2$ ratio was changed. Specifically, in steel 33, the final $CaO/SiO_2$ ratio was adjusted to 2.1. In steel 34, the amount of $ZrO_2$ such as in flux was adjusted to 0.8%. In steel 35, the amount of $ZrO_2$ such as in flux was adjusted to 0.7%, and

TABLE 11

| | Chemical composition (weight %) The balance: Fe and impurities | | | | | | | | | Average composition (%) | | | | | 0.2 mm steel wire | |
|---|---|---|---|---|---|---|---|---|---|---|---|---|---|---|---|---|
| Steel | C | Si | Mn | P | S | Al | N | O | Others | $SiO_2$ | CaO + $Al_2O_3$ | MgO | MnO | $ZrO_2$ | Tensile strength (MPa) | Fatigue strength (MPa) |
| 27 | 0.92 | 0.22 | 0.28 | 0.005 | 0.004 | 0.001 | 0.0032 | 0.0020 | Cu: 0.1, Ni: 1.3 | 89.2 | 4.2 | 1.1 | 2.3 | 3.2 | 4144 | 1240 |
| 28 | 0.77 | 0.16 | 0.43 | 0.005 | 0.007 | 0.002 | 0.0046 | 0.0024 | W: 0.2, B: 0.0029 | 93.2 | 4.2 | 1.3 | 1.2 | 0.1 | 3348 | 990 |
| 29 | 0.86 | 0.93 | 0.13 | 0.010 | 0.018 | 0.004 | 0.0021 | 0.0012 | Co: 1.9, Nb: 0.04 | 82.0 | 2.1 | 1.3 | 14.0 | 0.6 | 3820 | 1140 |
| 30 | 0.96 | 0.13 | 0.29 | 0.005 | 0.005 | 0.001 | 0.0019 | 0.0013 | Cr: 1.3, Mo: 0.04 | 75.1 | 18.2 | 2.1 | 1.7 | 2.9 | 4253 | 1270 |
| 31 | 0.61 | 0.12 | 0.50 | 0.008 | 0.008 | 0.001 | 0.0031 | 0.0021 | Cu: 0.3, B: 0.0006, Ti: 0.04 | 85.4 | 4.7 | 1.7 | 3.4 | 4.8 | 3210 | 970 |
| 32 | 0.84 | 0.21 | 0.12 | 0.008 | 0.005 | 0.002 | 0.0021 | 0.0019 | Zr: 0.03, Cu: 0.4 | 94.2 | 0.8 | 1.1 | 2.7 | 1.2 | 3940 | 1190 |
| 33 | 0.93 | 0.23 | 0.29 | 0.006 | 0.005 | 0.002 | 0.0031 | 0.0021 | Cu: 0.1, Ni: 1.2 | 72.1 | *22.3 | 3.0 | 2.1 | 0.5 | 4121 | 820 |
| 34 | 0.78 | 0.17 | 0.44 | 0.006 | 0.006 | 0.001 | 0.0045 | 0.0023 | W: 0.1, B: 0.0027 | 77.9 | 13.0 | 4.9 | 4.2 | *0 | 3318 | 660 |

TABLE 11-continued

| Steel | Chemical composition (weight %) The balance: Fe and impurities | | | | | | | | | Average composition (%) | | | | | 0.2 mm steel wire | |
|---|---|---|---|---|---|---|---|---|---|---|---|---|---|---|---|---|
| | C | Si | Mn | P | S | Al | N | O | Others | $SiO_2$ | CaO + $Al_2O_3$ | MgO | MnO | $ZrO_2$ | Tensile strength (MPa) | Fatigue strength (MPa) |
| 35 | 0.85 | 0.92 | 0.14 | 0.011 | 0.017 | 0.004 | 0.0022 | 0.0013 | Co: 1.8, Nb: 0.03 | *65.9 | 11.1 | 3.2 | 19.8 | *0 | 3831 | 760 |
| 36 | 0.95 | 0.12 | 0.27 | 0.004 | 0.006 | 0.001 | 0.0018 | 0.0014 | Cr: 1.4, Mo: 0.05 | *43.2 | *44.5 | 3.0 | 9.3 | *0 | 4260 | 850 |
| 37 | 0.62 | 0.13 | 0.51 | 0.009 | 0.006 | 0.001 | 0.0032 | 0.0022 | Cu: 0.2, B: 0.0005, Ti: 0.03 | *51.3 | *27.5 | 6.2 | 3.2 | *11.8 | 3189 | 630 |
| 38 | 0.83 | 0.21 | 0.13 | 0.007 | 0.004 | 0.002 | 0.0022 | 0.0018 | Zr: 0.02, Cu: 0.4 | *14.6 | *78.5 | 3.0 | 1.9 | 2.0 | 3920 | 730 |

The symbol "*" means that the content fails to satisfy the conditions specified in the invention.

the final $CaO/SiO_2$ ratio was adjusted to 0.6. In steel 36, the amount of $ZrO_2$ such as in flux was adjusted to 0.8%, and the final $CaO/SiO_2$ ratio was adjusted to 2.2. In steel 37, the amount of $ZrO_2$ such as in flux was adjusted to 81%, and the final $CaO/SiO_2$ ratio was adjusted to 2.2. In steel 38, the amount of mixed Al was adjusted to 7 g/ton, and the amount of $Al_2O_3$ such as in flux was adjusted to 12%, and further the final $CaO/SiO_2$ ratio was adjusted to 2.1. Steels 27 and 33, steels 28 and 34, steels 29 and 35, steels 30 and 36, steels 31 and 37, and steels 32 and 38 were adjusted to have almost similar chemical compositions.

The respective steels after continuous casting as described above were hot-rolled into wire rods of 5.5 mm in diameter while the rolling temperature and cooling rate were controlled in a usual manner. These wire rods were subjected to primary drawing (finish diameter: 2.8 mm), primary patenting treatment, and secondary drawing (finish diameter: 1.2 mm). Thereafter, these rods were further subjected to final patenting treatment (austenitizing temperature of 950 to 1050° C., and a lead bath temperature of 560 to 610° C.) and subsequently to brass plating, followed by wet drawing (finish diameter: 0.2 mm) at a drawing rate of 550 m/min.

An L section of a wire rod of 5.5 mm in diameter was polished, and its polished face was analyzed by an EPMA apparatus. The measurement result of the composition of oxides of 2 $\mu$m or more in width, as well as the tensile strength and fatigue strength of a 0.2 mm steel wire, is shown in Table 11. In this Example, the oxides of 2 $\mu$m or more in width on the L section of the wire rod were defined as $SiO_2$, CaO, $Al_2O_3$, MgO, MnO and $ZrO_2$, and the sum of the "average composition" in said hexamerous oxide system was assumed to be 100%, and this "average composition" examined. The fatigue strength is the result of a $10^7$ cycle test using a Hunter type rotating bending fatigue tester under the conditions of a temperature of 20 to 25° C. and a humidity of 50 to60%.

From Table 11, it is evident that because the average composition of the fine steel wires produced from wire rods made of steels 27 to 32 as stock steels satisfy the conditions specified in the present invention, they have higher fatigue strength than that of the fine steel wire rods made of steels 33 to 38 as stock steels outside the conditions specified in the present invention.

Table 12 shows the index of breakage of each steel (number of breakages per ton of steel wire (number/ton)) when a steel wire of 1.2 mm in diameter was wet-drawn to a steel wire of 0.2 mm in diameter.

TABLE 12

| Steel | Index of breakage (time/ton) |
|---|---|
| 27 | 0.1 |
| 28 | 0.1 |
| 29 | 0.1 |
| 30 | 0.1 |
| 31 | 0.1 |
| 32 | 0.1 |
| 33 | 11.2 |
| 34 | 5.5 |
| 35 | 11.2 |
| 36 | 9.5 |
| 37 | 18.4 |
| 38 | 18.9 |

From Table 12, it is evident that because the average compositions of wire rods made of steels 27 to 32 as stock steels satisfy the conditions specified in the present invention, the resulting steel wires have a low index of breakage and are excellent in drawing workability. On the other hand, the average compositions of wire rods made of steels 33 to 38 as stock steels do not fall under the conditions specified in the present invention, and the resulting steel wires have a high index of breakage and are inferior in drawing workability.

Products requiring excellent fatigue resistance and excellent cold workability, such as wire ropes, valve springs, suspension springs, PC wires, and steel cords can be produced efficiently by using the wire rods of the present invention as the stock under high productivity.

What is claimed is:

1. A steel wire rod containing oxides, wherein the average composition of oxides of 2 $\mu$m or more in width on a longitudinal section thereof comprises, on the weight % basis, $SiO_2$, 70% or more; $CaO+Al_2O_3$, less than 20%; and $ZrO_2$, 0.1 to 10%.

2. The steel wire rod according to claim 1, wherein $ZrO_2$ contained in the average composition of oxides of 2 $\mu$m or more in width on a longitudinal section thereof is 0.5 to 10% by weight.

3. The steel wire rod according to claim 1, wherein $ZrO_2$ contained in the average composition of oxides of 2 $\mu$m or more in width on a longitudinal section thereof is 1.0 to 10% by weight.

4. The steel wire rod according to claim 1, wherein $SiO_2$ contained in the average composition of oxides of 2 $\mu$m or more in width on a longitudinal section thereof is more than 75% to 95% by weight.

5. The steel wire rod according to claim 1, wherein $CaO+Al_2O_3$ contained in the average composition of oxides of 2 μm or more in width on a longitudinal section thereof is 1% or more to less than 15% by weight.

6. The steel wire rod according to claim 1, wherein $ZrO_2$, $SiO_2$ and $CaO+Al_2O_3$ contained in the average composition of oxides of 2 μm or more in width on a longitudinal section thereof are 0.5 to 10%, more than 75% to 95%, and 1% to less than 15% by weight, respectively.

7. The steel wire rod according to claim 1, wherein $ZrO_2$, $SiO_2$ and $CaO+Al_2O_3$ contained in the average composition of oxides of 2 μm or more in width on a longitudinal section thereof are 1.0 to 10%, more than 75% to 95%, and 1% to less than 15% by weight, respectively.

8. The steel wire rod according to claim 1, wherein the oxides of 2 μm or more in width on a longitudinal section thereof are composed of $SiO_2$, CaO, $Al_2O_3$, MgO, MnO, and $ZrO_2$, and the average composition thereof comprises, on the weight % basis, $SiO_2$, 70% or more; $CaO+Al_2O_3$, less than 20%; and $ZrO_2$, 0.1 to 10%.

9. The steel wire rod according to claim 1, wherein the chemical components in the steel comprise, on the weight % basis, C, 0.45 to 1.1%; Si, 0.1 to 2.5%; Mn, 0.1 to 1.0%; Zr, 0.1% or less and further comprise Cu, 0 to 0.5%; Ni, 0 to 1.5%; Cr, 0 to 1.5%; Mo, 0 to 0.5%; W, 0 to 0.5%; Co, 0 to 1.0%; B, 0 to 0.0030%; V, 0 to 0.5%; Nb, 0 to 0.1%; and Ti, 0 to 0.1%, the balance is Fe and incidental impurities, and in the impurities P is 0.020% or less, S is 0.020% or less, Al is 0.005% or less, N is 0.005% or less and O (oxygen) is 0.0025% or less.

10. The steel wire rod according to claim 8, wherein the chemical components in the steel comprise, on the weight % basis, C, 0.45 to 1.1%; Si, 0.1 to 2.5%; Mn, 0.1 to 1.0%; Zr, 0.1% or less and further comprise Cu, 0 to 0.5%; Ni, 0 to 1.5%; Cr, 0 to 1.5%; Mo, 0 to 0.5%; W, 0 to 0.5%; Co, 0 to 1.0%; B, 0 to 0.0030%; V, 0 to 0.5%; Nb, 0 to 0.1%; and Ti, 0 to 0.1%, the balance is Fe and incidental impurities, and in the impurities P is 0.020% or less, S is 0.020% or less, Al is 0.005% or less, N is 0.005% or less and O (oxygen) is 0.0025% or less.

* * * * *

UNITED STATES PATENT AND TRADEMARK OFFICE

CERTIFICATE OF CORRECTION

PATENT NO. : 6,277,220 B1
DATED : August 21, 2001
INVENTOR(S) : Hamada et al.

It is certified that error appears in the above-identified patent and that said Letters Patent is hereby corrected as shown below:

Title page,
Item [54], please change title to -- STEEL WIRE ROD --
Item [73], Assignee: please insert --SUMITOMO METAL INDUSTRIES, LTD. Osaka, Japan --
Item [74], please insert *Attorney, Agent,* or *Firm* is CLARK & BRODY Signed and Sealed this Eighteenth Day of June, 2002

*Attest:*

*Attesting Officer*

JAMES E. ROGAN
*Director of the United States Patent and Trademark Office*